United States Patent [19]

Lebraut

[11] Patent Number: 4,894,970

[45] Date of Patent: Jan. 23, 1990

[54] SPACER CAP FOR COVERING VARIOUS BUILDINGS

[75] Inventor: Richard Lebraut, Chatou, France

[73] Assignee: L. R. Etanco, Yvelines, France

[21] Appl. No.: 212,329

[22] Filed: Jun. 27, 1988

[30] Foreign Application Priority Data

Jun. 25, 1987 [FR] France ..... 87 08941

[51] Int. Cl.[4] ..... E04B 5/00

[52] U.S. Cl. ..... 52/410; 52/698

[58] Field of Search ..... 52/506, 508, 410, 698

[56] References Cited

U.S. PATENT DOCUMENTS

| | | | |
|---|---|---|---|
| 2,392,232 | 1/1946 | Crafton | 52/410 |
| 4,018,023 | 4/1977 | Anderson | 52/508 X |
| 4,545,270 | 10/1985 | Dewey | 52/512 X |
| 4,574,551 | 3/1986 | Giannuzzi | 52/506 X |
| 4,693,653 | 9/1987 | Schubert et al. | 52/410 X |

FOREIGN PATENT DOCUMENTS

| | | | |
|---|---|---|---|
| 2711335 | 9/1978 | Fed. Rep. of Germany | 52/410 |

*Primary Examiner*—Carl D. Friedman

*Attorney, Agent, or Firm*—Browdy & Neimark

[57] ABSTRACT

Each spacer comprises a foot portion of a polygonal cross section, which is rotatably lockable in a correspondingly profiled part of the plate. Each foot portion is topped by a star shaped surface and extended by a vertical rod or column terminated by a head portion which is hollow for passage of fastening means provided for maintaining the upper fixation element onto the head portion. The upper fixation elements are suitably stiffened by corrugation means and provided with a center hole for passage of the fastening means.

1 Claim, 1 Drawing Sheet

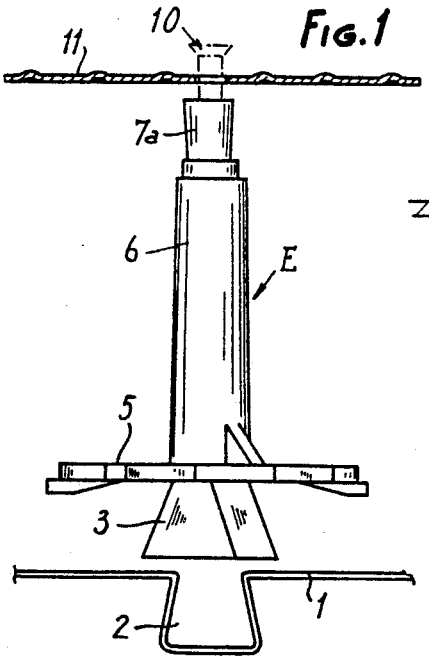
FIG. 1
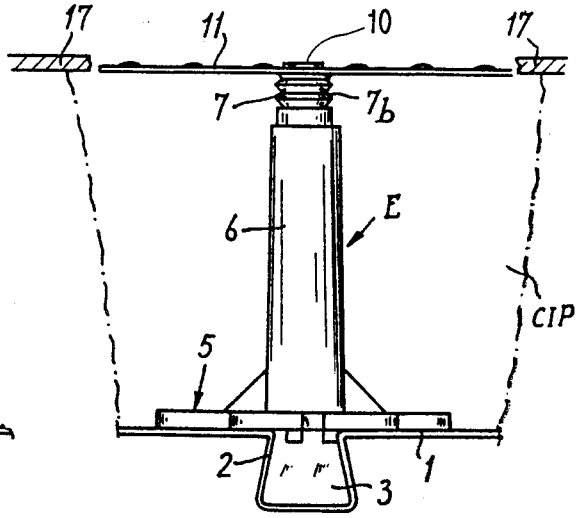
FIG. 2
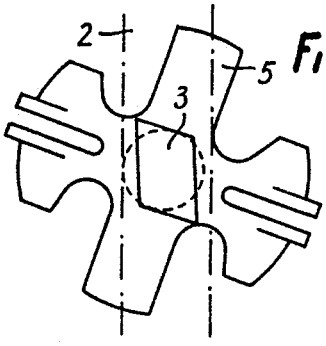
FIG. 3
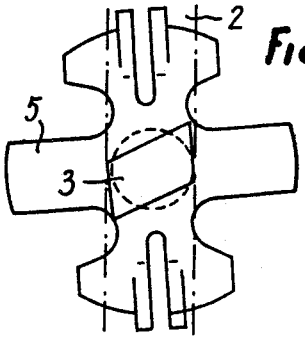
FIG. 4
FIG. 5
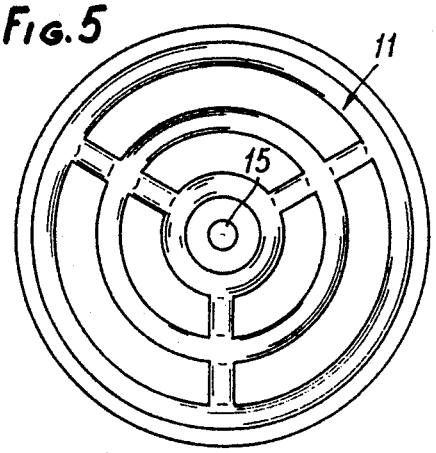
FIG. 6
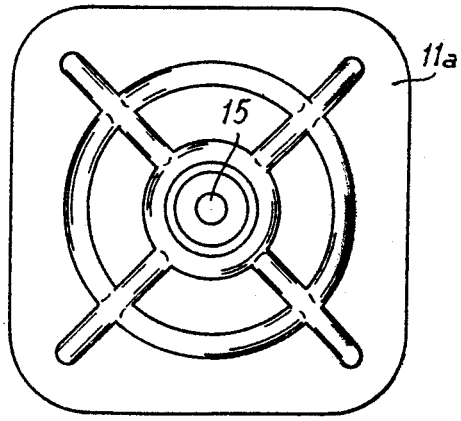

SPACER CAP FOR COVERING VARIOUS BUILDINGS

BACKGROUND OF THE INVENTION

Industrial coverings are more and more often made of plates provided with suitable profiled parts ensuring a sufficient stiffening even for a plate of a small thickness, these plates being then covered with a thermal and noise isolating layer formed by synthetic products, rock wool, regenerated cork or other inexpensive products, and which is coated on the outer surface thereof with a thin aluminum sheet on which there is thereafter spread a flame-retardant protective impervious coating.

However, for maintaining the thermal and noise isolating layer between the plate and the protecive impervious coating, it is necessary to provide maintaining means positioned from place to place for a correct maintaining of the thermically and phonically isolating layer, and also to create no thermal bridges in the roofing nor perforating points of the outer protective impervious coating.

BRIEF DESCRIPTION OF KNOWN PRIOR ART

U.S. Pat. No. 4,545,270 to Dewey relates to a fastener assembly for attaching roofing insulation to roof decks. A washer with a broad load-distributing flange has a crushable region which is deformed as the fastener becomes fully seated. This region insures that the joint is loaded with a predetermined force before the depth-sensitive driver disengages reducing the likelihood of overdriving or underdriving.

OBJECT OF THE INVENTION

The present invention has for its object a spacer which is fixed by its foot portion in a profiled part forming a stiffening element of a plate and has at its bottom portion a surface of any convenient shape provided to bear on an upper surface of the plate for ensuring a correct positioning of a rod or columm forming the maintaining means, this rod or columm terminating by an end enabling, by means of a screw or similar fastening means, a connection of each spacer with an upper fixation element for maintaining the isolating layer without risking to create thermal bridges, the spacer being made of a thermal and noise isolating material and the upper fixation element being maintained on the rod or columm of the spacer by the fastening means penetrating inside the rod or columm.

SUMMARY OF THE INVENTION

According to the invention:

a) each spacer comprises a rotatably lockable foot portion of a polygonal cross section, typically a rectangular parallelogram cross section, which is caused to be locked by a rotation comprised between 0° and 180° in a profiled part forming a stiffening element of the plate, each foot portion being topped by a star shaped surface and extended by a vertical rod or column terminated by a head portion, fastening means taken among a screw and the like being provided for maintaining the upper fixation element onto the head portion;

b) the spacer is made of an isolating plastics material preventing provision of a thermal bridge;

c) the head portion has a shape taken among a frustoconical shape and a cylindrical shape and is hollow for enabling to position the fastening means of the upper fixation elements;

d) each of the upper fixation elements is suitably stiffened by corrugation means and is provided with a center hole for passage of the fastening means, the upper fixation elements being made of a material taken among metal and plastics materials.

Several other features of the invention will become more apparent from the following description.

BRIEF DESCRIPTION OF THE DRAWINGS

Embodiment of the invention is shown by way of non limiting example in the accompanying drawings, wherein:

FIG. 1 is an exploded front view showing the spacer placed between a plate forming a roofing of a building and an upper fixation element of an isolating layer;

FIG. 2 is an elevation view of the spacer positioned on a roofing and maintaining the isolating layer;

FIGS. 3 and 4 are plane view showing a positioning of the foot portion of the spacer in a profiled part forming a stiffening element of the plate;

FIGS. 5 and 6 are plane views of two embodiments of the upper fixation elements.

DETAILED DESCRIPTION OF THE INVENTION

Referring now to the drawings, in FIG. 1, the plate 1, which is used as a lower roofing for a building, has an upper surface shaped from place to place with profiled parts 2 forming stiffening elements of the plate 1, and which, in the present case, have a dove-tail shaped cross section.

The spacer E which maintains a thermal and noise isolation layer CIP (FIG. 2) comprises a foot portion 3 having in cross section a rectangular parallelogramm shape and can easily penetrate into the profiled part 2. The foot portion 3, after having rotated by 90° as shown in FIGS. 3 and 4 (and in general between 0° and 180°) is blocked within the profiled part 2 while providing therefore a perfect positioning of the spacer E.

The spacer E has, just above its foot portion 3, a surface 5 having the shape of a four armed star bearing on the outer surface of the plate 1 and which maintains vertically a vertical rod or column 6 topped with a head 7. The head 7 can be of a smaller diameter than that of the column 6, and the end part of the head 7 is for example formed either in the shape of a truncated cone as shown at 7*a* in FIG. 1 or in the shape of a cylinder with an outer screw as shown at 7*b* in FIG. 2.

The vertical rod or column 6 is hollow and can therefore receive, samely as in a hollow pin of plastics material, a screw 10 which maintains an upper fixation element, which can be of a round shape as shown at 11 in FIG. 5, or of a square shape as shown at 11*a* in FIG. 6.

The upper fixation element 11 or 11*a* which will cover each spacer E bears on the upper surface of the isolation layer CIP covering the roof by providing a good thermal and noise isolation without risking to create thermal bridges. Actually the spacer E formed by the foot portion 3, the star shaped surface 5, the rod or column 6 and the head 7 or 7*a* is made of an isolating material, for example a plastics material. Therefore a screw, even if it is made of metal, does not create a thermal bridge.

Moreover, because of the rigidity of the rod or column 6, no movement of the upper fixation element 11 or 11*a* is possible, either toward the bottom or toward the top, which prevents therefore to tear an impervious coating 17 which is placed on the isolation layer CIP, the coating 17 being more often formed by a bituminous layer or the like.

It is thus possible to walk on the roof without risking to break the isolation or isolating layer and cause leaks in the roof.

The upper fixation elements 11 or 11*a* are made either of metal or of plastics material, and are suitably stiffened by corrugations such as those shown in FIGS. 5 and 6. Moreover, the upper fixation elements 11 or 11*a* may have various shapes taken among round, square and rectangular shapes. A hole 15 is centrally provided for passing the screw 10 or any other similar fastening member.

In some cases, it is possible to use the profiled part 2 forming a stiffening element for the plate 1 as a male hooking part by providing, on the lower part of the spacer E, a female part having a U, a V or a similar suitable cross section surrounding the profiled part 2. In this case, the female part is sized so as to be able to sufficiently slide on the profiled part 2 in order to suitably position the spacer E.

In all cases, the screw 10 can be substituted by a suitable male or female fastening means providing a perfect maintaining of the upper elements 11 or 11*a*.

What is claimed is:

1. A device for covering various buildings wherein an isolating layer is maintained on top of a plate forming an inner roofing of a building by tightening the isolating layer between an upper surface of the plate and upper fixation elements placed above the isolating layer with interposition from place to place of a plurality of spacers, and wherein:

(a) each spacer comprises a rotatably lockable foot portion of a polygonal cross section, typically a rectangular parallelogramm cross section, which is caused to be locked by a rotation comprised between 0° and 180° in a correspondingly profiled part of the plate, each foot portion being topped by a star shaped surface and extended by a vertical rod or column terminated by a head portion, fastening means (10) taken among a screw and the like being provided for maintaining the upper fixation element onto the head portion;

(b) the spacer is made of an isolating plastics material preventing provision of a thermal bridge;

(c) the head portion has a shape taken among a frustoconical shape and a cylindrical shape and is hollow for enabling to position the fastening means of the upper fixation elements;

(d) each of the upper fixation elements is suitably stiffened by corrugation means and is provided with a center hole for passage of the fastening means, said upper fixation elements being made of a material taken among metal and plastic materials.

* * * * *